US007487888B1

(12) United States Patent
Pierre, Jr.

(10) Patent No.: US 7,487,888 B1
(45) Date of Patent: Feb. 10, 2009

(54) FLUID DISPENSING APPARATUS

(76) Inventor: Lloyd A. Pierre, Jr., 2847 N. 2175 East, Layton, UT (US) 84040

( * ) Notice: Subject to any disclaimer, the term of this patent is extended or adjusted under 35 U.S.C. 154(b) by 457 days.

(21) Appl. No.: 11/182,182

(22) Filed: Jul. 15, 2005

(51) Int. Cl.
*B67D 5/56* (2006.01)
*B67D 5/60* (2006.01)
*B65D 35/22* (2006.01)

(52) U.S. Cl. ..... 222/144.5; 222/23; 222/94; 222/145.4; 222/145.7

(58) Field of Classification Search ..... 222/144.5, 222/133, 142.6, 145.1, 145.5–145.8, 145.3, 222/94, 129, 175, 527, 529, 475, 23; 220/714; 224/148.1, 148.2, 148.4; 239/33
See application file for complete search history.

(56) References Cited

U.S. PATENT DOCUMENTS 557,352 A 3/1896 Bender
704,105 A * 7/1902 Read ..... 222/144.5
2,118,704 A * 5/1938 Grontkowski ..... 222/61
3,198,394 A * 8/1965 Lefer ..... 222/135
4,856,995 A 8/1989 Wagner
D342,022 S 12/1993 Pritchard
5,385,270 A * 1/1995 Cataneo et al. ..... 222/134
5,588,550 A 12/1996 Meyer
5,794,819 A 8/1998 Smith
5,921,440 A 7/1999 Maines
6,152,326 A * 11/2000 Klima et al. ..... 222/82
6,450,351 B1 9/2002 Thompson
6,793,387 B1 * 9/2004 Neas et al. ..... 366/160.4
6,974,051 B1 * 12/2005 Lin ..... 222/25
2004/0262331 A1 * 12/2004 Woolfson et al. ..... 222/145.5

* cited by examiner

*Primary Examiner*—Kevin P Shaver

(57) ABSTRACT

A fluid dispensing apparatus includes a container that has a bottom wall, a top wall and a peripheral wall that is attached to and extends between the top and bottom walls. A dividing wall is positioned in the container and divides the container into a first section and a second section. A first tube and a second tube are provided. Each of the first and second tubes has a top end and a bottom end. The first tube is fluidly coupled to the first section and the second tube is fluidly coupled to the second section. Each of the bottom ends is positioned adjacent to the bottom wall. A third tube has a first end and a second end. The first end is fluidly coupled to each of the top ends of the first and second tubes.

9 Claims, 3 Drawing Sheets

FLUID DISPENSING APPARATUS

BACKGROUND OF THE INVENTION

1. Field of the Invention

The present invention relates to fluid holding devices and more particularly pertains to a new fluid holding device for allowing a person to selectively choose between one or two fluids.

2. Description of the Prior Art

The use of fluid holding devices is known in the prior art. U.S. Pat. No. 5,921,440 describes a container adapted for holding two fluid condiment and a cover that allows a person to selectively determine which of the condiments will be dispensed. Another type of fluid holding device is U.S. Pat. No. 5,794,819 which again allows a person to select between two fluids contained with a container. Yet another such device is found in is U.S. Pat. No. 557,352 which includes a nozzle that may be fluidly coupled to one of a plurality of compartments positioned within a single container.

While these devices fulfill their respective, particular objectives and requirements, the need remains for a device that allows a person to carry with them, and selectively access, two selectively accessible fluids. This will allow a person, particularly one exercising, to choose between fluids such as water in one container and an electrolyte containing fluid within another container. Further, the device will allow the two fluids to be selectively mixed and dispensed. Additionally, it is preferred that the device includes a valve that is color coded for providing feedback to a person using the device as to which container it is they are drinking out of.

SUMMARY OF THE INVENTION

The present invention meets the needs presented above by generally comprising a container that has a bottom wall, a top wall and a peripheral wall that is attached to and extends between the top and bottom walls. A dividing wall is positioned in the container and divides the container into a first section and a second section. A first tube and a second tube are provided. Each of the first and second tubes has a top end and a bottom end. The first tube is fluidly coupled to the first section and the second tube is fluidly coupled to the second section. Each of the bottom ends is positioned adjacent to the bottom wall. A third tube has a first end and a second end. The first end is fluidly coupled to each of the top ends of the first and second tubes.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
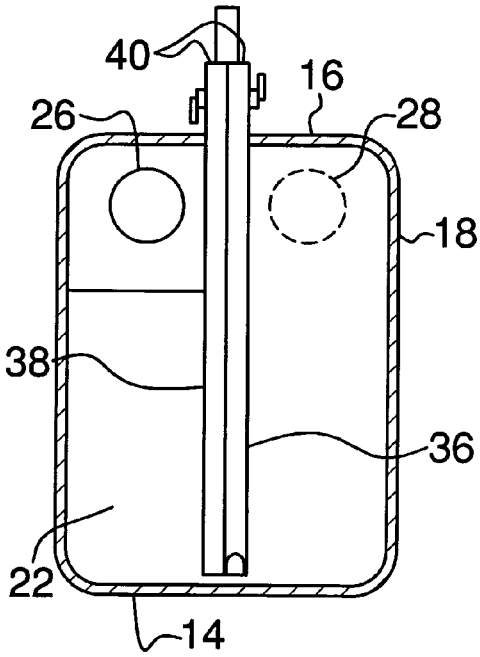
FIG. 2 is a cross-sectional view taken along line 2-2 of FIG. 1 of the present invention.

With reference now to the drawings, and in particular to FIGS. 1 through 8 thereof, a new fluid holding device embodying the principles and concepts of the present invention and generally designated by the reference numeral 10 will be described.

Figure 3:
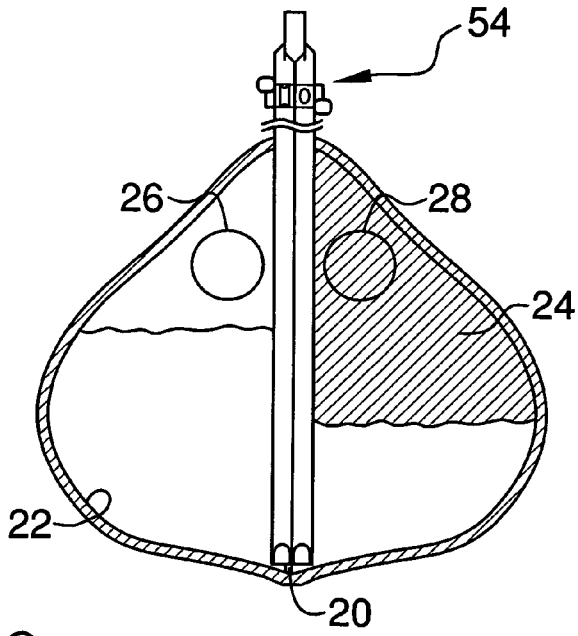
FIG. 3 is a cross-sectional view of a second embodiment of the present invention.
Figure 1:
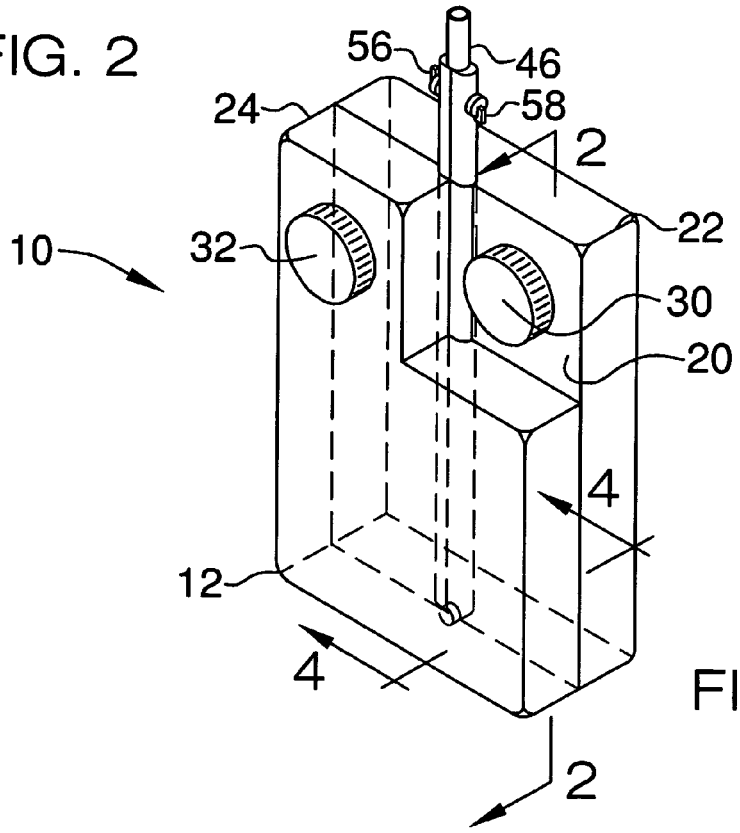
FIG. 1 is a perspective view of a first embodiment of a fluid dispensing apparatus according to the present invention.
Figure 4:
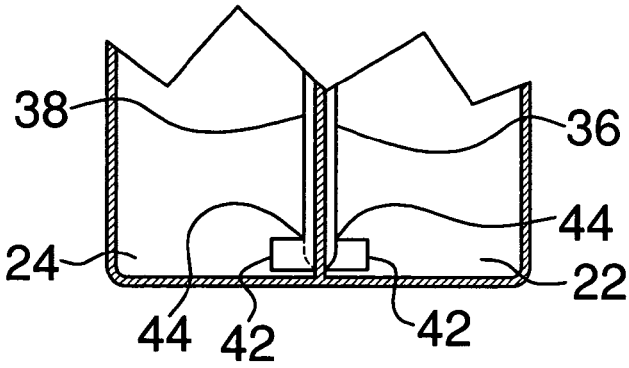
FIG. 4 is a cross-sectional view taken along line 4-4 of FIG. 1 of the present invention.
Figure 8:
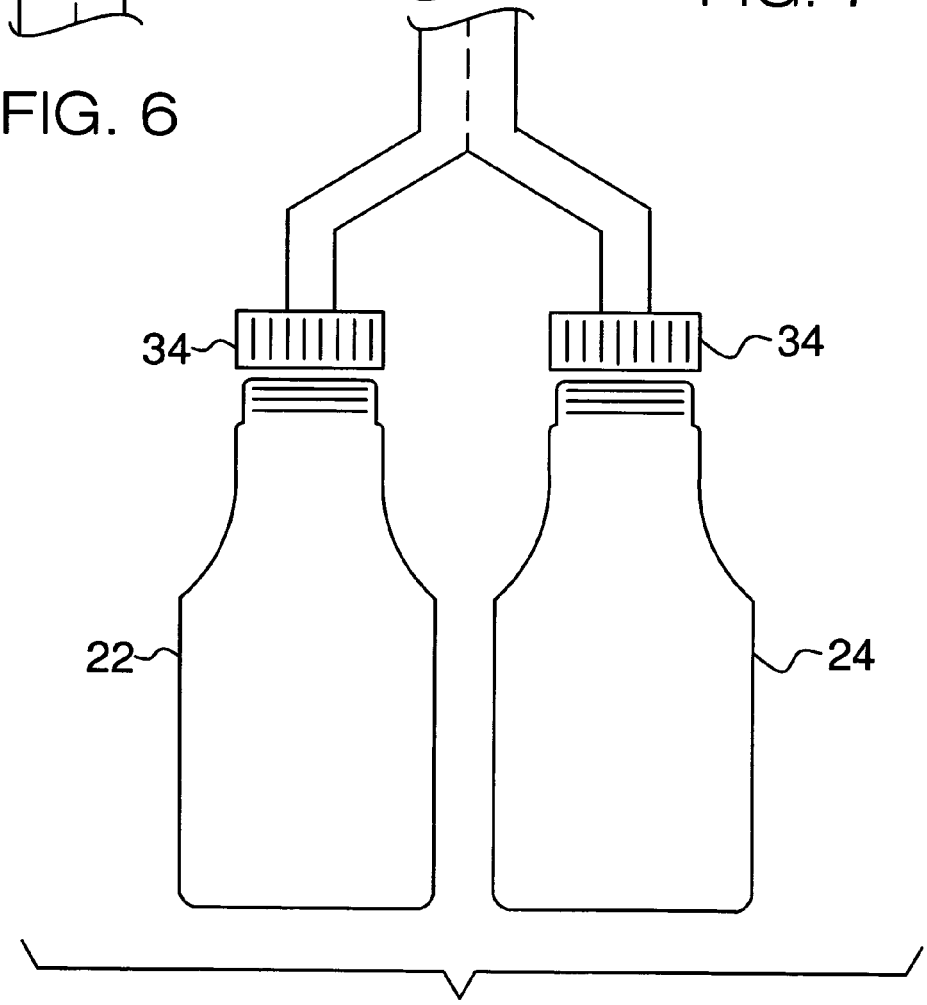
FIG. 8 is a front view of a fourth embodiment of the present invention.

As best illustrated in FIGS. 1 through 8, the fluid dispensing apparatus 10 generally comprises a container 12 that has a bottom wall 14, a top wall 16 and a peripheral wall 18 that is attached to and extends between the top 16 and bottom 14 walls. A dividing wall 20 is positioned in the container 12 and divides the container 12 into a first section 22 and a second section 24. The first section 22 has a first opening 26 extending therein and the second section 24 has a second opening 28 extending therein. Each of the first 22 and second 24 sections has an internal volume between 10 ounces and 50 ounces. FIGS. 3 and 4 show embodiments wherein the dividing wall extending between front and back walls of the container 12 where as FIG. 1 shows an embodiment wherein the dividing 20 wall is parallel with the front and back walls. FIG. 8 shows a fourth embodiment wherein the first 22 and second 24 sections are separate from each other. The first 26 and second 28 openings are preferably large enough to receive a conventionally sized ice cube having a diameter equal to about 1 inch.

A first cover 30 is removably positionable over the first opening 26 and a second cover 32 removably positionable over the second opening 28. The first cover 30 is colored a first color and the second cover 32 is colored a second color. FIG. 8 shows an embodiment wherein the container 12 includes covers 34 that also form the top walls of the first 26 and second 28 sections.

Figure 5:
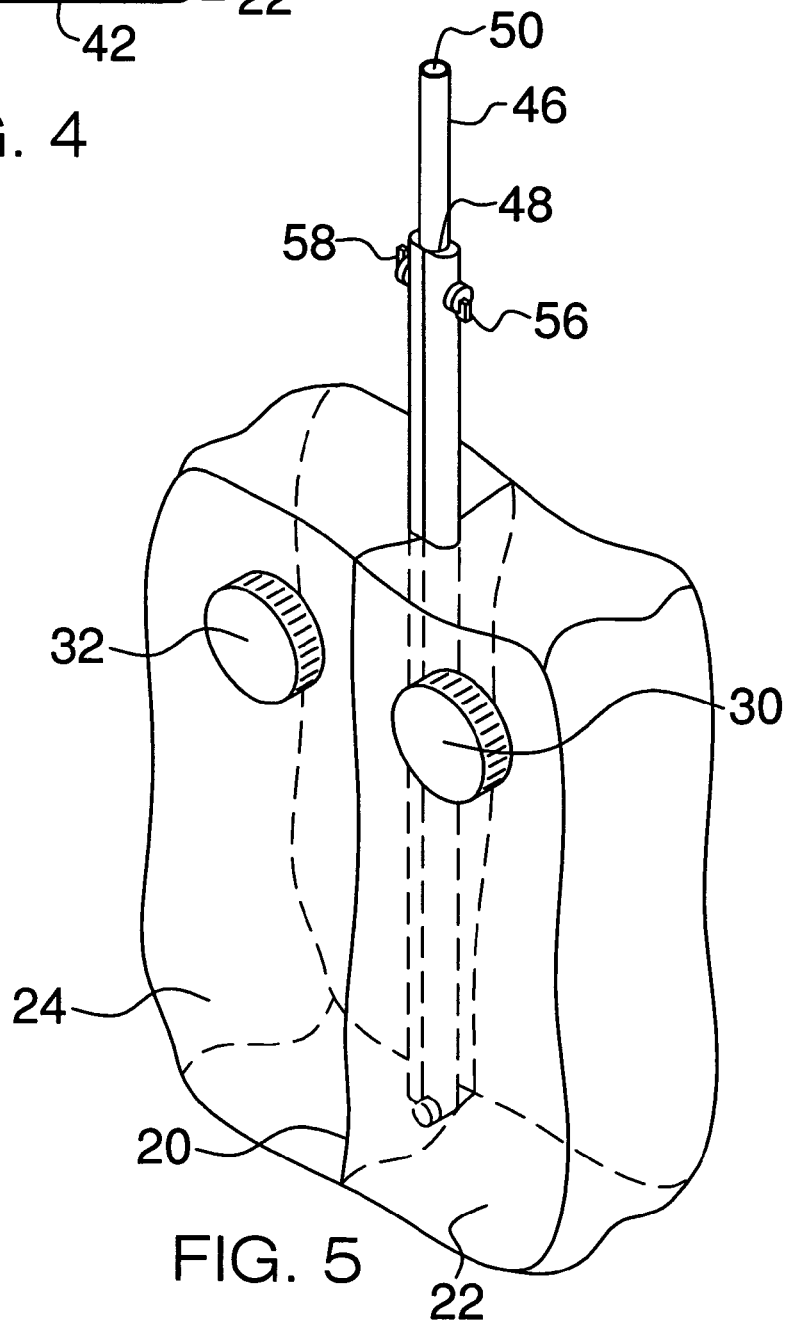
FIG. 5 is a perspective view of a third embodiment of the present invention.
Figure 6:
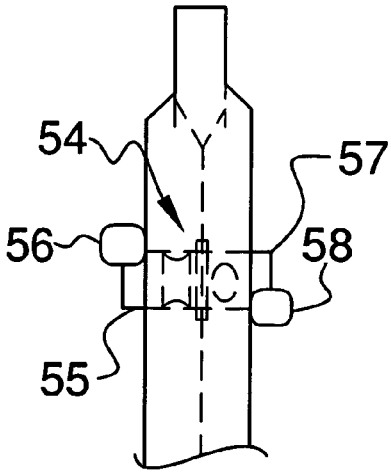
FIG. 6 is a front view of a valve of the present invention.
Figure 7:
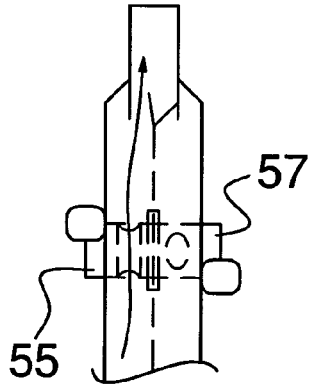
FIG. 7 is a front view of a valve and cover of the present invention.
Figure 7:
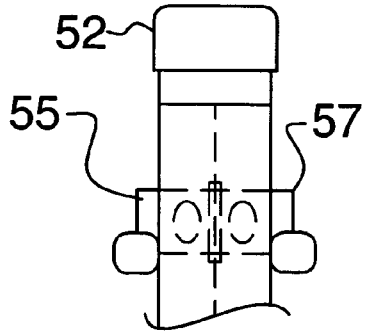

A first tube 36 and a second tube 38 are provided. Each of the first 36 and second 38 tubes has a top end 40 and a bottom end 42. The first tube 36 extends through the top wall 16 and is fluidly coupled to the first section 22. The second tube 38 extends through the top wall 16 and is fluidly coupled to the second section 24. Each of the bottom ends 42 is positioned adjacent to the bottom wall 14. Each of the first 36 and second 38 tubes has a bend 44 therein positioned adjacent to the bottom ends 42. The bends 44 ensure that that the bottom ends 42 are not plugged by the bottom wall 14 when the container 12 is constructed of a flexible material as shown in FIG. 5. A third tube 46 has a first end 48 and a second end 50. The first end 48 is fluidly coupled to each of the top ends 40 of the first 36 and second 38 tubes. A cap 52 may be removably positionable on the second end 50 of the third tube 46.

A valve assembly 54 is fluidly coupled to each of the first 36 and second 38 tubes. The valve assembly 54 is positioned between the top ends 40 and the top wall 16 of the container 12. The valve assembly 54 includes a first valve 55 and a second valve 57 being operational independent of each other. The first valve 55 is in fluid communication with the first tube 36 and is configured for selectively opening or closing the first tube 36. The second valve 57 is in fluid communication with the second tube 36 and is configured for selectively opening or closing the second tube 36. Preferably, the first valve 55 has an actuator 56 colored a first color and the second valve 57 has an actuator 58 colored a second color.

In use, the first section 22 is filled with a first fluid and the second section 24 is filled with a second fluid. This allows a person using the container 12 to carry two different fluids so that they may selectively determine which fluid is required at specific times. The person may also selectively mix the fluids by opening both of the first 55 and second 57 valves. Selecting the percentage that each of the first 55 and second 57 valves is opened may also vary the percentage of the components of the mixture. This allows a concentrate to be placed in the first section 22 and water in the second section 24. The second section 24 can then be refilled as needed.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A fluid dispensing apparatus comprising:

a container having a bottom wall, a top wall and a peripheral wall being attached to and extending between said top and bottom walls, a dividing wall being positioned in said container and dividing said container into a first section and a second section;

a first tube and a second tube, each of said first and second tubes having a top end and a bottom end, said first tube being fluidly coupled to said first section, said second tube being fluidly coupled to said second section, each of said bottom ends being positioned adjacent to said bottom wall;

a third tube having a first end and a second end, said first end being fluidly coupled to each of said top ends of said first and second tubes; and a valve assembly being fluidly coupled to each of said first and second tubes, said valve assembly being positioned between said top ends and said top wall of said container, said valve assembly being configured to selectively open said first and second tubes, said valve assembly including a first valve and a second valve being operational independent of each other, said first valve being in fluid communication with said first tube and being configured to selectively open or close said first tube, said second valve being in fluid communication with said second tube and being configured to selectively open or close said second tube an actuator colored a first color being attached to said first valve and an actuator colored a second color being attached to said second valve.

2. The apparatus according to claim 1, said first section having a first opening extending therein and said second section having a second opening extending therein, a pair of covers, each of said covers being removably positionable over one of said first and second openings, said first and second openings being positioned in said peripheral wall.

3. The apparatus according to claim 2, wherein each of said first and second tubes extend through said top wall of said container.

4. A fluid dispensing apparatus comprising:

a container having a bottom wall, a top wall and a peripheral wall being attached to and extending between said top and bottom walls, a dividing wall being positioned in said container and dividing said container into a first section and a second section, said first section having a first opening extending therein and said second section having a second opening extending therein, each of said first and second sections having an internal volume between 10 ounces and 50 ounces;

a first cover being removably positionable over said first opening, a second cover removably positionable over said second opening, said first cover being colored a first color, said second cover being colored a second color;

a first tube and a second tube, each of said first and second tubes having a top end and a bottom end, said first tube extending through said top wall and being fluidly coupled to said first section, said second tube extending through said top wall and being fluidly coupled to said second section, each of said bottom ends being positioned adjacent to said bottom wall, each of said first and second tubes having a bend therein positioned adjacent to said bottom ends;

a third tube having a first end and a second end, said first end being fluidly couple to each of said top ends of said first and second tubes; and a valve assembly being fluidly coupled to each of said first and second tubes, said valve assembly being positioned between said top ends and said top wall of said container, said valve assembly including a first valve and a second valve being operational independent of each other, said first valve being in fluid communication with said first tube and being configured to selectively open or close said first tube, said second valve being in fluid communication with said second tube and being configured to selectively open or close said second tube, an actuator colored a first color being attached to said first valve and an actuator colored a second color being attached to said second valve.

5. A fluid dispensing apparatus comprising:

a container having a bottom wall, a top wall and a peripheral wall being attached to and extending between said top and bottom walls, a dividing wall being positioned in said container and dividing said container into a first section and a second section, said first section having a first opening extending therein and said second section having a second opening extending therein;

a pair of covers, each of said covers being removably positionable over one of said first and second openings, one of said covers being colored a first color and one of said colors being colored a second color;

a first tube and a second tube, each of said first and second tubes having a top end and a bottom end, said first tube being fluidly coupled to said first section, said second tube being fluidly coupled to said second section, each of said bottom ends being positioned adjacent to said bottom wall; and a third tube having a first end and a second end, said first end being fluidly coupled to each of said top ends of said first and second tubes.

6. The apparatus according to claim 5, wherein each of said first and second tubes extend through said top wall of said container.

7. The apparatus according to claim 5, further including a valve assembly being fluidly coupled to each of said first and second tubes, said valve assembly being positioned between said top ends and said top wall of said container, said valve assembly being configured to selectively open said first and second tubes.

8. The apparatus according to claim 7 said valve assembly including a first valve and a second valve being operational independent of each other, said first valve being in fluid communication with said first tube and being configured to selectively open or close said first tube, said second valve being in fluid communication with said second tube and being configured to selectively open or close said second tube.

9. The apparatus according to claim 8, further including an actuator colored a first color being attached to said first valve and an actuator colored a second color being attached to said second valve.

* * * * *